United States Patent [19]

Carville

[11] Patent Number: 4,476,846

[45] Date of Patent: Oct. 16, 1984

[54] ADJUSTABLE ARROW SUPPORT

[76] Inventor: Kenneth D. Carville, 19 Canna Dr., Shrewsbury, Mass. 01545

[21] Appl. No.: 287,370

[22] Filed: Jul. 27, 1981

[51] Int. Cl.[3] ..... F41B 5/00

[52] U.S. Cl. ..... 124/41 A

[58] Field of Search ..... 124/41 A, 24 R, 88, 124/86

[56] References Cited

U.S. PATENT DOCUMENTS

| | | | |
|---|---|---|---|
| 3,292,607 | 12/1966 | Hoyt | 124/24 R X |
| 3,757,764 | 9/1973 | Ikeya | 124/41 A |
| 3,865,096 | 2/1975 | Troncosco, Jr. | 124/24 |
| 3,890,951 | 6/1975 | Jennings et al. | 124/41 |
| 3,918,428 | 11/1975 | Wilson et al. | 124/41 |
| 4,170,980 | 10/1979 | Killian | 124/41 |

OTHER PUBLICATIONS

"Hunter-11"-Archery Magazine, May, 1975.

*Primary Examiner*—Richard J. Apley
*Assistant Examiner*—William R. Browne
*Attorney, Agent, or Firm*—Blodgett & Blodgett

[57] ABSTRACT

Apparatus for supporting an arrow on a bow, the apparatus including a main support having a transverse spindle which has an arrow rest at one end and which is adjustable independently both axially and rotatably.

4 Claims, 5 Drawing Figures

FIG. 3
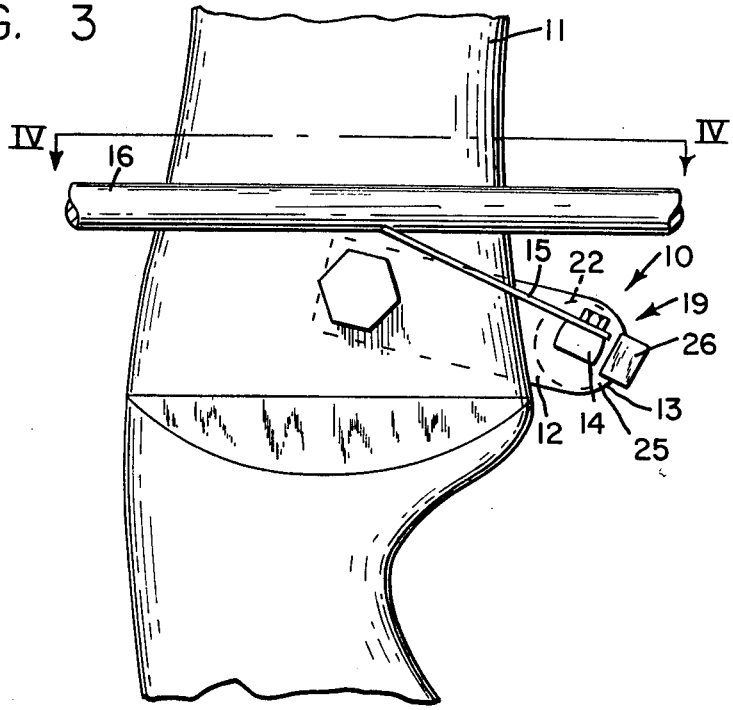
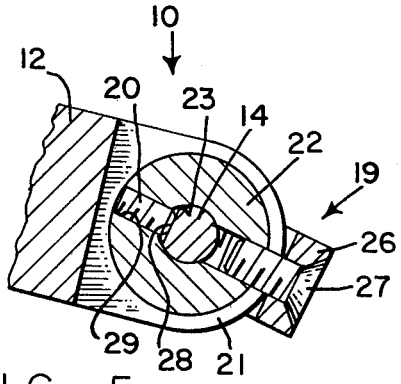
FIG. 5
FIG. 4
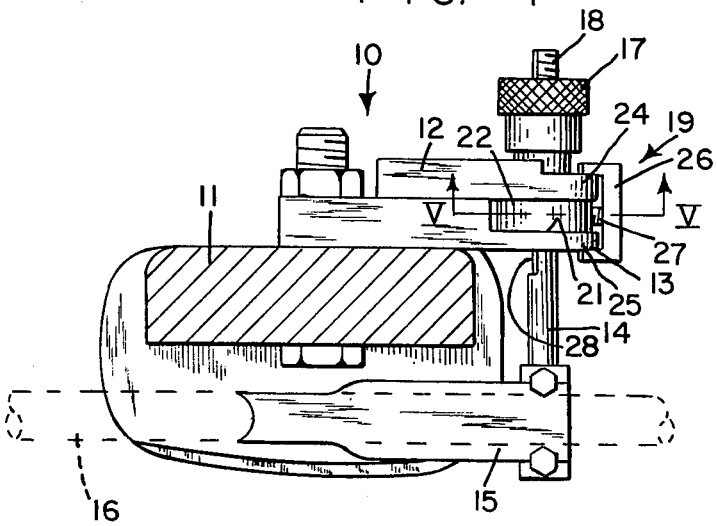

ADJUSTABLE ARROW SUPPORT

BACKGROUND OF THE INVENTION

In the sport of archery the equipment has become very complex and technical, particularly when used for target shooting in competition. Among the equipment that is available are devices for the release of the bow strings and sighting equipment for aiming the arrow. However, despite this available equipment, inaccuracies in shooting arise because of variations in the location of the arrow relative to the bow. Although the rear end or nock o the arrow is accurately located on the bow string because of a nock set that is normally used shooter's finger or on a step molded into the structure of the bow. In the shooting of rifles, for instance, the bullet leaves the rifle in a direct and straight line down range determined by the barrel, the rifle sights then are used for elevation and windage corrections. No such situation exists in the sport of archery and, therefore, inaccuracies can be introduced for that reason. The fact that the arrow is compressed and bent by the forces acting on its rear end produces the so-called "archer's paradox" and leads to a weaving path for the arrow that is greatly accentuated if the arrow is even slightly inclined to the line of force. In other words, it is desireable to select an arrow setting that gives a perfectly reproduceable path. Attempts have been made in the past to provide equipment for making the adjustment of the arrow relative to the bow, but the equipment that has been developed is complicated and expensive and is not practical in the field. These and other difficulties experienced with the prior art devices have been obviated in a novel manner by the present invention.

It is, therefore, an outstanding object of the invention to provide an apparatus including an arrow rest that permits in dependent adjustment of the arrow relative to the bow both in a vertical angle and in a horizontal angle.

Another object of this invention is the provision of an arrow adjustment apparatus which is simple and rugged in construction, which is inexpensive to manufacture, and which is capable of a long life of useful service with a minimum of maintenance.

A further object of the present invention is the provision of an apparatus for supporting an arrow, the structure of which is not delicate, so that it is useful under field conditions and is not easily damaged or put out of adjustment.

It is another object of the instant invention to provide a support for an arrow which permits easy adjustment of the arrow relative to the bow to compensate independently for elevation and windage.

A still further object of the invention is the provision of an arrow adjustment apparatus which has a simple and artistic appearance that is compatible with the appearance of the other archery equipment.

With these and other objects in view, as will be apparent to those skilled in the art, the invention resides in the combination of parts set forth in the specification and covered by the claims appended hereto.

SUMMARY OF THE INVENTION

In general, the invention consists of an arrow adjusting apparatus for use with a bow, which apparatus has a main support adapted to be attached to the bow with one end extending rearwardly of the bow. A threaded spindle extends transversely through the said one end of the support and has an arrow rest at one end. A nut is rotatably mounted on the other end of the spindle and is threadedly engaged therewith. A lock is provided to prevent rotation of the spindle relative to the support on occasion.

More specifically, the arrow rest is in the form of a thin strip of metal which extends angularly from the spindle and moves up and down when the spindle is rotated. One end of the main support is curved and is provided with a slot in which is carried a disc that is keyed to the spindle, so that rotation of the disc causes rotation of the spindle. A bridge extends across the slot to engage the curved end of the support and has a screw mounted in it to fasten it to the disc and to press it against the curved end of the support.

BRIEF DESCRIPTION OF THE DRAWINGS

The character of the invention, however, may be best understood by reference to one of its structural forms, as illustrated by the accompanying drawings, in which:

FIG. 3 is an enlarged side elevational view of the apparatus, FIG. 4 is a plan view of the apparatus taken on the line IV—IV of FIG. 3, and FIG. 5 is a sectional view of the apparatus taken on the line V—V of FIG. IV.

DESCRIPTION OF THE PREFERRED EMBODIMENT

Figure 1:
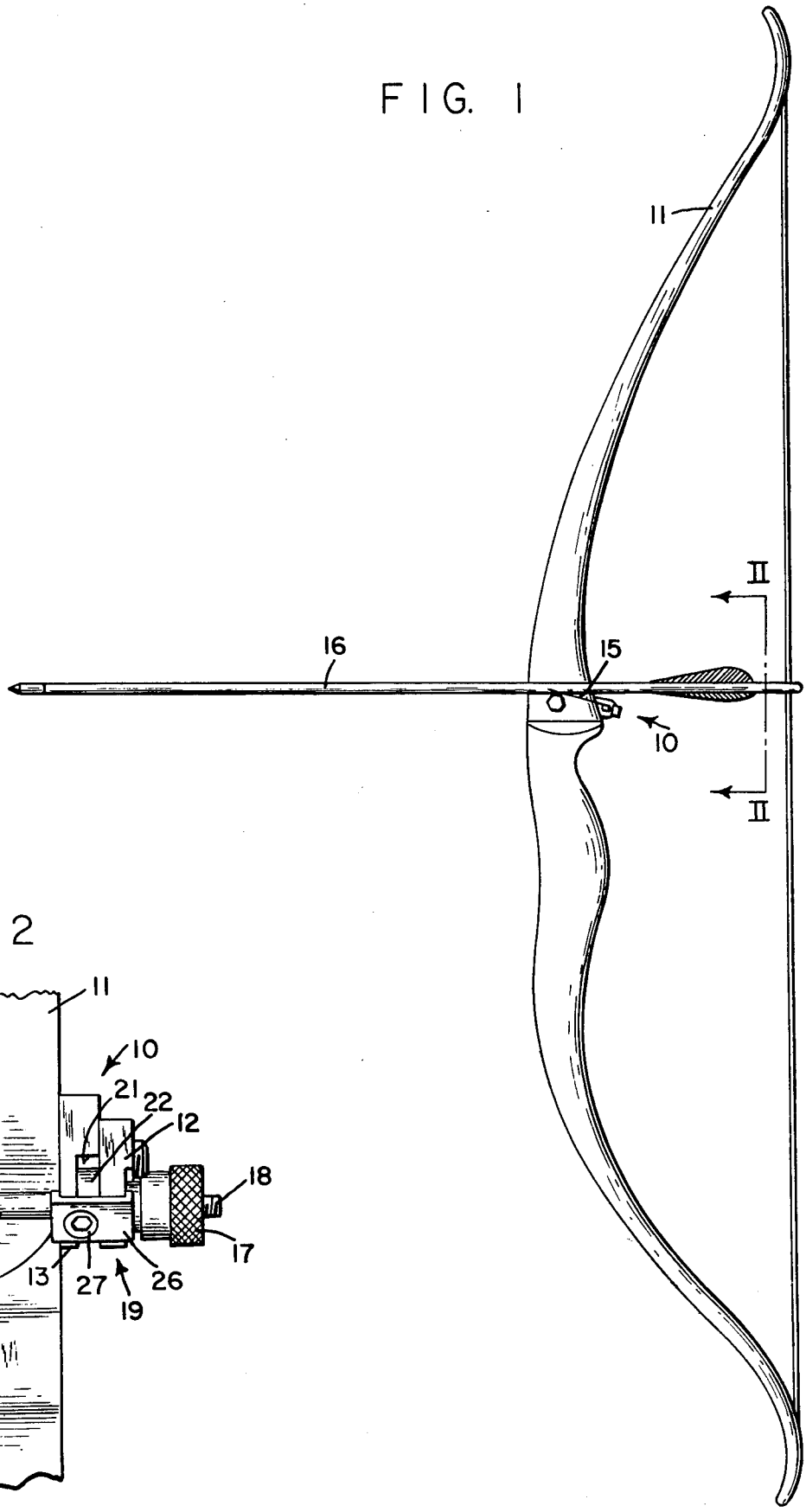
FIG. 1 is a side elevational view of an arrow adjusting apparatus embodying the principles of the present invention and shown in use on a bow.

Referring first to FIG. 1, wherein are best shown the general features of the invention, it can be seen that the arrow adjusting apparatus, indicated generally by the reference numeral 10, is shown mounted on a bow 11 and carrying an arrow 16.

Figure 2:
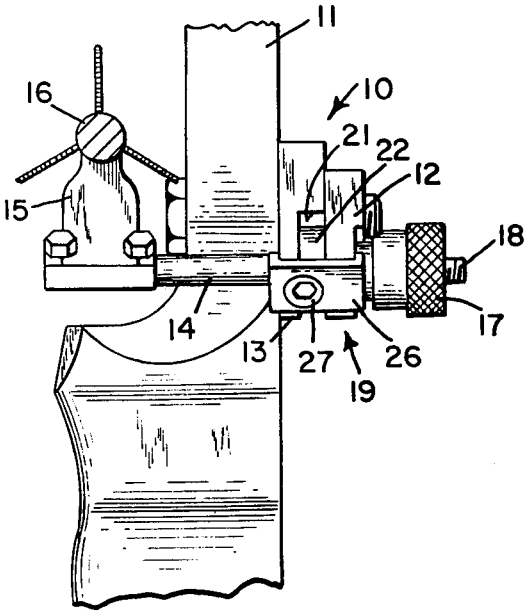
FIG. 2 is an enlarged rear elevational view of the apparatus taken on the line II—II of FIG. 1.

Referring next to FIGS. 2 and 3, it can be seen that the apparatus 10 is provided with a main support 12 which is mounted to the bow with one end 13 extending rearwardly of the bow a short distance. A spindle 14 extends transversely through the said one end of the support and is provided with an arrow rest 15 at one end. A nut 17 has a threaded bore by which it is threaded on threads 18 located on the other end of the spindle where it emerges from the support.

A lock, indicated generally by the reference numeral 19, is mounted on the said one end of the support normally to prevent rotation of the spindle relative to the support.

The arrow rest 15 is in the form of a thin metal plate and is fastened to the spindle so that it extends radially therefrom. The arrow rest is provided at its outer end with a concave curved surface whose radius is generally the same as that of the arrow. This surface receives the arrow to locate it accurately relative to the bow.

The said one end of the support which extends rearwardly of the bow is provided with a vertical slot 21. A lock 22 lies in the slot and the spindle 14 extends through the block in a sliding but non-rotative mode through an aperture 23 in the block.

As is evident in FIGS. 4 and 5, the block 22 in the preferred embodiment is in the form of a disc whose axis is concentric with the spindle 14 and which fits snugly between the sides of the slot in the support. The spindle 14 is provided in its end portion with a flat surface 28. The block 22 is provided with an aperture 29 for receiving a set screw 20 to bring about the non-rotative but sliding connection between the two elements 14 and 22. The support 12 is provided with spaced, parallel end portions 24 and 25 which have semicylindrical surfaces that are concentric with the surface of the disc-like block 22 and in general constitute extensions thereof. The brake or bridge 26 extends across the end portions 24 and 25 and across the slot 21 with its inwardly-directed surface closely adjacent to the cylindrical surface of the block. A socket-head screw 27 is mounted on and extends through the bridge for threaded engagement with a threaded radial bore in the block. When the screw 27 is tightened, the bridge engages the end portions 24 and 25 and the disc is held against rotation, thus allowing axial movement of the spindle without rotative movement.

The operation and advantages of the invention will now be readily understood in view of the above description. In shooting an arrow accurately from a bow, it is usually necessary to provide a sight on the bow. By means of this sight, the bow is not only held perfectly vertically, but the arrow can be aimed at the target at the same time. This provides compensation for the fact that a certain amount of horizontal wind may be blowing transversely of the flight path and, furthermore, that the target may have a different distance from the bow requiring different amounts of elevation. The arrow is located accurately along the bow string by means of a nock set which is attached to the bow string and against which the nock of the arrow is placed. This determines the relationship of the rear end of the arrow to the bow string and to the bow in general. The relationship of the remainder of the arrow, relative to the bow is adjusted by moving the arrow rest 15 vertically and horizontally, respectively, relative to the bow. The horizontal movement of the arrow rest 15 and the arrow 16 is accomplished by sliding the spindle 14 laterally relative to the support 12 and bow 11. The vertical movement of the front end of the arrow, however, is brought about by raising the arrow rest by rotating the spindle 14. It is possible with the present invention to accomplish these two adjustments independently of one another. In order to obtain transverse motion of the spindle, it is necessary that the nut 17 be rotated and this must be done so that the rotation does not also provide rotation of the spindle 14. For this purpose, it is only necessary to operate the set screw 27 in such a way that the bridge 26 engages the end portions 24 and 25 tightly. When this is done, rotation of the nut 17 will produce transverse motion of the spindle 14 in either direction (depending on the direction of rotation of the nut). The nut in rotating engages the threads 18 on the spindle and forces the spindle laterally and the spindle in so moving carries the arrow rest with it.

If it is desirable to raise or lower the front end of the arrow, this is accomplished by rotating the spindle 14. The manner in which this is accomplished is by simply loosening the screw 27 so that it is possible to rotate the disc or block 22. Since the block is keyed to the spindle 14, this causes the arrow rest to move up and down to a desired angle to the spindle after which it is only necessary to tighten up the screw 27 again to lock the setting.

It can be seen, then, that the present invention provides a simple method of adjusting the relationship of an arrow to the bow. This has the effect of reducing the deleterious effect of "archer's paradox" to a minimum. It is possible to move the arrow in a horizontal angle relative to the bow and the bow string to compensate for any horizontal component and to similarly adjust the vertical angle.

The simplicity of the construction renders it very strong and not likely to be rendered inoperative or inaccurate by exposure to the rough elements of the weather and of usage. Furthermore, because of its nature, it is not likely to be put out of adjustment easily.

It is obvious that minor changes may be made in the form and construction of the invention without departing from the material spirit thereof. It is not, however, to confine the invention to the exact for herein shown and desired, but it is desired to include all such as properly come within the scope claimed.

The invention having been thus described, what is claimed as new and desired to secure by Letters Patent is:

1. Arrow adjusting apparatus for use with bow, comprising:
   (a) a main support,
   (b) mounting means for attaching the main support to the bow so that one end of said support extends rearwardly of the bow,
   (c) a threaded spindle which extends transversely through said one end of the support for rotational and axial movement relative to said one end, said spindle having an arrow rest at one end,
   (d) a nut threaded on the spindle so that rotation of the nut causes said spindle to move axially relative to the support, and
   (e) locking means for selectively locking said spindle against rotation relative to said support while permitting the spindle to move axially relative to said support, wherein the said one end of the support is provided with a slot and wherein said locking means consists of a block which lies within said slot, said block having an aperture through which said spindle extends for axial sliding, but non-rotative, movement relative to said block and clamping means for clamping the block to the support.

2. Arrow adjusting apparatus as recited in claim 1, wherein the block is in the form of a disc whose axis is concentric with the spindle and fits snugly between the sides of the slot in the support, and wherein the spindle is provided in its central portion with a non-circular cross-section.

3. Arrow adjusting apparatus as recited in claim 2, wherein the disc has a threaded radial bore and the slot in the support is defined by two spaced, parallel end portions, the end portions having semi-cylindrical portions that are concentric with and are extensions of the corresponding surface of the disc, and wherein said clamping means comprises:
   (a) a bridge which extends across the end portions and across the slot adjacent the cylindrical surface of the disc, and
   (b) a screw mounted on the bridge for selective engagement with said threaded radial bore for clamping the support.

4. Arrow adjusting apparatus as recited in claim 1, wherein the arrow rest is in the form of a thin metal plate fastened to and extending radially from the spindle at the said one end, and wherein the opposite end of the spindle is provided with threads and carries the nut.

* * * * *